United States Patent [19]

Viscovich et al.

[11] Patent Number: 5,020,589

[45] Date of Patent: Jun. 4, 1991

[54] SYSTEM FOR REMOVING UNCONDENSED PRODUCTS FROM A STEAM TURBINE CONDENSER

[75] Inventors: Paul W. Viscovich, Longwood; James A. Martin, Winter Springs, both of Fla.

[73] Assignee: Westinghouse Electric Corp., Pittsburgh, Pa.

[21] Appl. No.: 555,332

[22] Filed: Jul. 19, 1990

[51] Int. Cl.[5] ..... F28B 9/10

[52] U.S. Cl. ..... 165/112; 60/685; 60/690; 60/694

[58] Field of Search ..... 165/112; 60/685, 688, 60/690, 694

[56] References Cited

U.S. PATENT DOCUMENTS 1,230,557 6/1917 Brown ..... 165/112

1,342,471 6/1920 Suazek ..... 165/112

*Primary Examiner*—Albert W. Davis, Jr.

[57] ABSTRACT

A steam condenser system for a turbine, which system includes: a condenser having an outlet for conveying uncondensed products out of the condenser; an exhauster having a housing, an inlet connected between the housing and the condenser outlet, and exhaust outlet connected to the housing, and a rotatable member, disposed in the housing and rotatable about an axis for propelling uncondensed products from the exhauster inlet to the exhauster outlet; and an electric motor having an output shaft connected for rotating the rotatable member. The motor is disposed relative to the exhauster such that the motor shaft forms an angle with the horizontal and extends in a downward direction from the motor to the exhauster. Preferably, the motor shaft and the axis of rotation of the rotatable member have a substantially vertical orientation and the motor is positioned above the rotatable member.

18 Claims, 1 Drawing Sheet

SYSTEM FOR REMOVING UNCONDENSED PRODUCTS FROM A STEAM TURBINE CONDENSER

BACKGROUND OF THE INVENTION

The present invention relates to condenser systems for steam turbines, and particularly the condenser system components for exhausting uncondensed products.

Fossil and nuclear steam turbine installations include gland steam condenser systems, composed of shell and tube heat exchangers, which serve to prevent the escape, to the atmosphere, of sealing steam from the turbine element shaft ends. Such a condenser system also functions to prevent escape to the atmosphere of high pressure leakage steam flowing along turbine inlet valve stems. Gland steam is piped from a zone between the air seal and outermost steam seal of each steam gland of the turbine elements to the condenser system. Similarly, high pressure valve stem leakage is conducted from a zone between the air seal and the outermost stem steam seal to the condenser system.

The mixture of gland steam and valve stem sealing leakage steam is condensed by heat exchange with condensate pumped from the main condenser hotwell through tubes in the gland steam condenser system. After almost all of the steam has condensed, non-condensible vapors, air, and any non-condensed water vapor are removed by a motor driven exhauster. The exhauster further establishes a vacuum in the gland condenser, as well as at the turbine element glands and valve leakoff zones.

A drain pipe at the bottom of the condenser shell conducts condensate from the condenser to a main condenser or to a drain tank.

FIG. 1 illustrates the basic components of a known system of this type. The system includes a condenser 2 having couplings for receiving steam to be condensed and a liquid coolant, which may be condensate pumped from the main condenser hotwell, and serves as the site of a heat exchange which produces the desired condensation. Condensate formed in condenser 2 is removed via a drain 4. Uncondensed products, including non-condensible vapors, air and any non-condensed water vapor, flow out of condenser 2 via an outlet pipe 6 and an exhauster inlet pipe 8 to an exhauster 10. From exhauster 10, the uncondensed products are vented via an exhauster outlet 12.

Within outlet pipe 6 there is mounted a valve 14, which may be a manually operated butterfly valve, and between pipe 6 and exhauster inlet pipe 8 there is disposed a check valve 16 serving to assure unidirectional flow of the uncondensed products. when two exhausters are used with one as a standby.

Exhauster 10 contains a rotatable member 10', typically an impeller, which is connected to the shaft 18 of an electric motor 20. Rotation of the impeller within exhauster 10 creates a low pressure within exhaust inlet pipe 8, so that uncondensed products are withdrawn from condenser 2 via outlet pipe 6 and exhauster inlet pipe 8. Butterfly valve 14 may be adjusted to provide the desired sub-atmospheric pressure level at the outlet of condenser 2 which is connected to pipe 6. Motor 20 is mounted on a stand 24. Exhauster 10 has a circular form in a plane perpendicular to that of FIG. 1 and rotation of impeller 10' within exhauster 10 produces a radial flow of uncondensed products from a central region communicating with inlet pipe 8 to a peripheral region in communication with exhauster outlet 12. Any condensate collecting in exhauster 10 may be removed via a drain fitting 26.

Frequently, a system of the type illustrated in FIG. 1 will include two exhausters, each coupled to a respective outlet pipe 6 and driven by a respective motor 20, primarily so that a back-up unit is available.

Despite the provision of drain fitting 26, there have been numerous occurrences of water collecting in the housing of exhauster 10, resulting in severe damage to rotating components within exhauster 10. In some instances, flooding has been so extensive that the water has reached the centerline of shaft 18 and has caused electrical shorting of motor 20. Such flooding has resulted from various causes, including failure to open the drain line connected to fitting 26, improperly designed drain lines, and clogging of the drain lines.

When an exhauster fails, the result is loss of vacuum at the shaft steam seals and the valve stems. Consequently, gross steam leakage can occur through the seals and into the turbine hall. The escaping seal steam can also travel along the turbine shaft and enter the oil seals, thereby contaminating the lubricating oil system

SUMMARY OF THE INVENTION

It is a primary object of the present invention to prevent failure of such an exhauster device and its associated drive motor due to flooding of the exhauster housing.

Another object of the invention is to enhance the operating reliability of the exhauster of a turbine steam condenser system.

A more specific object of the invention is to prevent, in a passive manner, flooding of the housing of a motor-driven exhauster.

The above and the other objects are achieved, according to the invention, in a steam condenser system for a turbine, which system includes: a condenser having an outlet for conveying uncondensed products out of the condenser; an exhauster having a housing, an inlet connected between the housing and the condenser outlet, an exhaust outlet connected to the housing, and a rotatable member disposed in the housing and rotatable about an axis for propelling uncondensed products from the exhauster inlet to the exhauster outlet; and an electric motor having an output shaft connected for rotating the rotatable member, by the improvement wherein the motor is disposed relative to the exhauster such that the motor shaft forms an angle with the horizontal and extends in a downward direction from the motor to the exhauster.

The relative positions of the motor and exhauster according to the present invention virtually eliminate the possibility of flooding the exhauster or of the water reaching the electrical components of the drive motor.

DESCRIPTION OF THE PREFERRED EMBODIMENT

Figure 2:
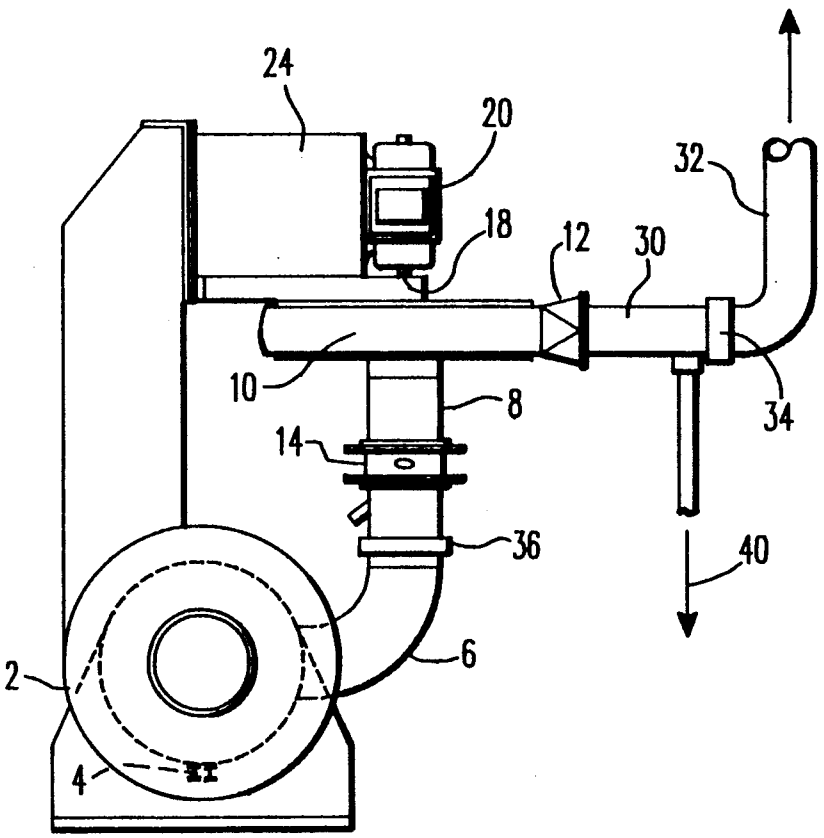
FIG. 2 is a view similar to that of FIG. 1 illustrating the arrangement of the exhauster and associated components according to an embodiment of the present invention.
Figure 1:
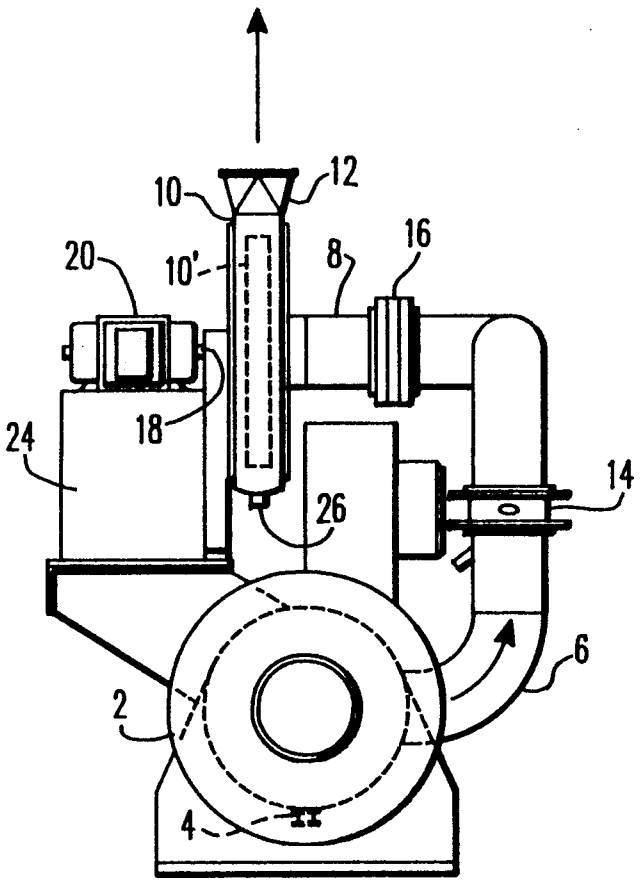
FIG. 1 PRIOR ART
FIG. 1 is a end elevational view of a conventional steam condenser system, which has been described above.

A preferred embodiment of the present invention is illustrated in FIG. 2, where components identical to those of the arrangement of FIG. 1 are identified by the same reference numerals, and will not be described in detail again.

As is immediately apparent from a study of FIG. 2, the arrangement illustrates therein differs from that of FIG. 1 in that exhauster 10, motor shaft 18, and motor 20 are oriented at right angles to the orientation shown in FIG. 1 and motor 20 is located above exhauster 10. This produces a self-draining arrangement which virtually eliminates the possibility of water collecting in the housing of exhauster 10 or contacting the electric components of motor 20. In addition, in view of the vertical orientation of the axis of inlet pipe 8, the check valve 16 shown in FIG. 1 may be eliminated. when only one exhauster is used.

As further shown in FIG. 2, exhauster outlet 12 is connected to exhaust piping having a horizontal section 30 and a vertical section 32 via which uncondensed exhaust products are vented or removed from the turbine installation. These exhaust products may be further treated according to requirements imposed on the particular installation.

In further accordance with the invention, one or more moisture removal devices 34 and 36 may be provided. A preferred location for such a moisture removal device is shown at 34, while an alternate location in shown at 36. Each moisture removal device 34, 36 can be of a conventional type. Two known types which may be used are known as a demister mesh and a chevron arrangement. Any moisture removed by device 36 will flow backward through outlet pipe 6 into condenser 2, from which it may exit via drain 4.

Furthermore, exhaust piping section 30 may be provided with a further drain line 40, particularly when moisture removal device 34 is provided.

It should be noted, however, that even if moisture removal devices 34 and 36, and drain line 40 were not provided, any liquid collecting in exhaust piping section 30 or within exhauster 10 would simply flow downwardly via exhauster inlet pipe 8 and outlet pipe 6 into condenser 2, and from there through drain 4. Thus, while it may be advantageous to provide one or both moisture removal devices 34, 36, the arrangement according to the present invention will inherently prevent the flooding of the interior, or housing, of exhauster 10 and will prevent any flow of water into motor 20.

However, the provision of one or both moisture removal devices 34, 36 serves to prevent condensible products from being vented and lost to the atmosphere. Any water flowing through drain line 40 may be returned to the main condenser of the installation.

Further, since the system according to the invention utilizes the same components as those currently employed, retrofitting of a system in accordance with the present invention could be accomplished with a minimum of expense and difficulty.

Moreover, the present invention can eliminate the need for a back-up exhauster unit, since the danger of failure due to flooding is virtually completely eliminated.

Because of the orientation of exhauster 10 according to the present invention, the exhauster outlet 12 may be directly coupled to a horizontal exhaust piping section 30 and this facilitates the removal of liquid which may accumulate downstream of exhauster 10. Similarly, the vertical orientation of exhauster inlet pipe 8 assures the drainage of any condensate forming in exhauster 10 back into condenser 2.

Moisture removal device 36 may be eliminated in those installations where it may adversely affect the suction pressure at outlet pipe 6.

Arrangements according to the present invention will minimize the occurrence of visible vapors in the exhaust, or atmospheric plumes, from an installation, and this will offer certain public relations benefits in the case of nuclear plants.

While, in preferred embodiments of the invention, exhauster 10 and motor 20 are oriented so that motor shaft 18 is vertical, it will be appreciated that many benefits of the invention can be achieved with an orientation which is somewhat nonvertical, provided that the center of exhauster 10 is disposed below the electrical components of motor 20.

While the description above relates to particular embodiments of the present invention, it will be understood that many modifications may be made without departing from the spirit thereof. The pending claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

We claim:

1. In a steam condenser system for a turbine, which system includes: a condenser having an outlet for conveying uncondensed products out of the condenser; an exhauster having a housing, an inlet connected between the housing and the condenser outlet, an exhaust outlet connected to the housing, and a rotatable member, disposed in the housing and rotatable about an axis for propelling uncondensed products from the exhauster inlet to the exhauster outlet; and an electric motor having an output shaft connected for rotating the rotatable member, the improvement wherein said motor is disposed relative to said exhauster such that said motor shaft forms an angle with the horizontal and extends in a downward direction from said motor to said exhauster.

2. A system as defined in claim 1 wherein said motor shaft and the axis of rotation of said rotatable member have a substantially vertical orientation and said motor is positioned above said rotatable member.

3. A system as defined in claim 2 wherein said rotatable member is an impeller located within said housing.

4. A system as defined in claim 2 wherein said exhauster inlet is oriented to define an upwardly extending flow path.

5. A system as defined in claim 4 wherein the flow path defined by said exhauster inlet has a vertical orientation.

6. A system as defined in claim 2 further comprising an exhaust pipe coupled to said exhauster outlet and defining a flow path which forms a angle with the vertical.

7. A system as defined in claim 6 wherein the flow path defined by said exhaust pipe has a horizontal orientation.

8. A system as defined in claim 6 further comprising a condensate drain coupled to said exhaust pipe.

9. A system as defined in claim 8 further comprising a liquid removal device disposed in the flow path defined by said exhaust pipe.

10. A system as defined in claim 9 wherein said condensate drain is located between said moisture removal device and said exhaust outlet.

11. A system as defined in claim 6 further comprising a liquid removal device disposed in the flow path defined by said exhaust pipe.

12. A system as defined in claim 11 wherein said condensate drain is located between said moisture removal device and said exhaust outlet.

13. A system as defined in claim 2 further comprising a liquid removal device located between said condenser outlet and said exhauster for intercepting liquid flowing from said condenser to said exhauster.

14. A system as defined in claim 12 wherein said exhauster inlet is oriented to define an upwardly extending flow path.

15. A system as defined in claim 14 wherein the flow path defined by said exhauster inlet has a vertical orientation.

16. A system as defined in claim 1 wherein said exhauster inlet is oriented to define an upwardly extending flow path.

17. A system as defined in claim 16 further comprising an exhaust pipe coupled to said exhauster outlet and defining a flow path which forms an angle with the vertical.

18. A system as defined in claim 1 further comprising an exhaust pipe coupled to said exhauster outlet and defining a flow path which forms an angle with the vertical.

* * * * *